US007845219B2

(12) United States Patent
Goodwin et al.

(10) Patent No.: US 7,845,219 B2
(45) **Date of Patent: *Dec. 7, 2010**

(54) METHOD AND APPARATUS FOR SAMPLING FORMATION FLUIDS

(75) Inventors: Anthony R. H. Goodwin, Sugar Land, TX (US); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 54 days.

This patent is subject to a terminal disclaimer.

(21) Appl. No.: 12/435,449

(22) Filed: May 5, 2009

(65) Prior Publication Data

US 2009/0211752 A1 Aug. 27, 2009

Related U.S. Application Data

(62) Division of application No. 11/851,584, filed on Sep. 7, 2007, now Pat. No. 7,703,317.

(60) Provisional application No. 60/845,332, filed on Sep. 18, 2006.

(51) Int. Cl.
*E21B 49/10* (2006.01)

(52) U.S. Cl. ..... 73/152.24; 73/152.39

(58) Field of Classification Search ..... 73/152.05, 73/152.07, 152.11, 152.12, 152.17, 152.39, 73/152.41; 166/100, 166, 264, 272.1, 400
See application file for complete search history.

(56) References Cited

U.S. PATENT DOCUMENTS

| | | | |
|---|---|---|---|
| 5,269,180 | A | 12/1993 | Dave et al. |
| 5,325,918 | A | 7/1994 | Berryman et al. |
| 5,644,076 | A | 7/1997 | Proett et al. |
| 6,230,557 | B1 | 5/2001 | Ciglenec et al. |
| 7,090,012 | B2 | 8/2006 | Hill et al. |
| 7,204,309 | B2 | 4/2007 | Segura et al. |
| 2003/0034777 | A1 | 2/2003 | Chen et al. |
| 2005/0279499 | A1 | 12/2005 | Tarvin et al. |
| 2005/0284629 | A1 | 12/2005 | Reid et al. |
| 2006/0000606 | A1 | 1/2006 | Fields et al. |

(Continued)

FOREIGN PATENT DOCUMENTS

| | | |
|---|---|---|
| DE | 2709661 | 9/1978 |

(Continued)

OTHER PUBLICATIONS

Burgess et al., Formation Testing and Sampling through Casing, Oilfield Review, pp. 46-57 (Spring 2002).

*Primary Examiner*—John Fitzgerald
(74) *Attorney, Agent, or Firm*—Dave R. Hofman

(57) ABSTRACT

A method of retrieving a formation fluid from a formation adjacent a borehole wall includes estimating at least one of a permeability of the formation and a viscosity of the formation fluid. A first tool is selected based on the estimation, the first tool being selected from one of a heating and sampling tool, an injection and sampling tool, and a coring tool. An attempt to retrieve a formation fluid sample from the formation is then made with the first tool, and a formation fluid sample is retrieved from the formation. A second retrieval process may then be initiated, in which the second retrieval process includes increasing the mobility of the formation fluid.

13 Claims, 11 Drawing Sheets

U.S. PATENT DOCUMENTS

| | | | |
|---|---|---|---|
| 2006/0042793 | A1 | 3/2006 | Del Campo et al. |
| 2008/0066534 | A1 | 3/2008 | Reid et al. |
| 2008/0066535 | A1 | 3/2008 | Vasques et al. |
| 2008/0078581 | A1 | 4/2008 | Goodwin et al. |
| 2008/0115574 | A1 | 5/2008 | Meek |
| 2008/0115575 | A1 | 5/2008 | Meek et al. |

FOREIGN PATENT DOCUMENTS

| | | |
|---|---|---|
| GB | 2431673 | 5/2007 |
| WO | WO02070864 | 9/2002 |
| WO | WO2004097176 | 11/2004 |

METHOD AND APPARATUS FOR SAMPLING FORMATION FLUIDS

CROSS-REFERENCE TO RELATED APPLICATIONS

This application is a divisional application of U.S. patent application Ser. No. 11/851,584, filed Sep. 7, 2007, now U.S. Pat. No. 7,703,317, which is a non-provisional application of U.S. Provisional Patent Application No. 60/845,332, filed Sep. 18, 2006, the contents of both of which are incorporated herein by reference for all purposes.

BACKGROUND

1. Field of the Disclosure

This disclosure generally relates to oilfield exploration. More particularly, this disclosure relates to techniques for drawing fluids from a formation into a downhole tool.

2. Background of the Disclosure

"Heavy oil" or "extra heavy oil" are terms of art used to describe very viscous crude oil as compared to "light crude oil". Such highly viscous crude oils are often referred to as "low mobility formation fluids". Large quantities of heavy oil can be found in the Americas, in particular, Canada, Venezuela, and California. Historically, heavy oil was less desirable than light oil. The viscosity of the heavy oil makes production very difficult. Heavy oil also contains contaminants and/or many compounds which make refinement more complicated. Recently, advanced production techniques and the rising price of light crude oil have made production and refining of heavy oil economically feasible.

Heavy oil actually encompasses a wide variety of very viscous crude oils. Medium heavy oil generally has a density of 903 to 906 $kg \cdot m^{-3}$, an API (American Petroleum Institute) gravity of 25° to 18°, and a viscosity of 10 to 100 mPa·s. It is a mobile fluid at reservoir conditions and may be extracted using for example cold heavy oil production with sand (CHOPS). Extra heavy oil generally has a density of 933 to 1,021 $kg \cdot m^{-3}$, an API gravity of 20° to 7°, and a viscosity of 100 to 10,000 mPa·s. It is a fluid that can be mobilized at reservoir conditions and may be extracted using heat injection techniques, such as cyclic steam stimulation, steam floods, and steam assisted gravity drainage (SAGD) or solvent injection techniques such as vapor assisted extraction (VAPEX). Tar sands, bitumen, and oil shale generally have a density of 985 to 1,021 $kg \cdot m^{-3}$, an API gravity of 12° to 7°, and a viscosity in excess of 10,000 mPa·s. They are not mobile fluids where the formation temperature is approximately 10° C. (in Canada), and must be extracted by mining. Hydrocarbons with similar densities and API gravities, but with viscosities less than 10,000 mPa·s can be partially mobile where the formation temperature is approximately 50° C. (in Venezuela).

Various tools and techniques have been proposed to increase the mobility of a highly viscous formation fluid, such as heavy oils and bitumen, thereby to obtain a sample. The proposed techniques typically employ a single approach, such as coring into, applying heat to, or injecting a fluid into a formation in an attempt to retrieve a sample of the highly viscous formation fluid, regardless of the particular characteristics of the particular formation or viscous fluid. Tools which perform these techniques further typically execute a predetermined process, again without taking into account the characteristics of the particular formation makeup or fluid.

SUMMARY

It is therefore an object of this disclosure to provide tools and methods which expedite the sampling of formation fluids, and particularly, although not exclusively, the sampling of high viscosity hydrocarbons or low mobility fluids.

According to one aspect of this disclosure, a method of retrieving a formation fluid from a formation adjacent a borehole wall is disclosed which includes estimating at least one of a permeability of the formation and a viscosity of the formation fluid or a fluid mobility in the formation. A first tool is selected based on the estimation, the first tool being selected from one of a heating and sampling tool, an injection and sampling tool, and a coring tool. An attempt to retrieve a formation fluid sample from the formation is then made with the first tool, and a formation fluid sample is retrieved from the formation.

According to additional aspects, a method of retrieving a formation fluid from a formation adjacent a borehole wall is provided in which a tool is lowered into the wellbore. A first retrieval process is initiated in which the first retrieval process includes attempting to increase the mobility of the formation fluid. At least one downhole parameter related to the mobility of the fluid is then measured, and the first retrieval process is changed based on the measured downhole parameter. A second retrieval process is then initiated, in which the second retrieval process includes increasing the mobility of the formation fluid. The fluid sample is then retrieved from the formation with the tool.

Additional objects and advantages of this disclosure will become apparent to those skilled in the art upon reference to the detailed description taken in conjunction with the provided figures.

DETAILED DESCRIPTION

Techniques for retrieving formation fluid are disclosed herein. According to one method disclosed herein, a characteristic of the formation (such as permeability) and/or of the fluid (such as viscosity) is estimated. Based on the estimation, a fluid retrieving tool, such as a heating and sampling tool, an injection and sampling tool, or a coring tool, is selected. A downhole tool may carry multiple retrieving tools so that the desired tool may be selected. According to an additional technique, a downhole tool may initiate a retrieval process, measure a downhole parameter related to the mobility of the fluid, and change the first retrieval process based on the measured downhole parameter. Additionally, a second retrieval process may be initiated to increase the mobility of the formation fluid.

Figure 1:
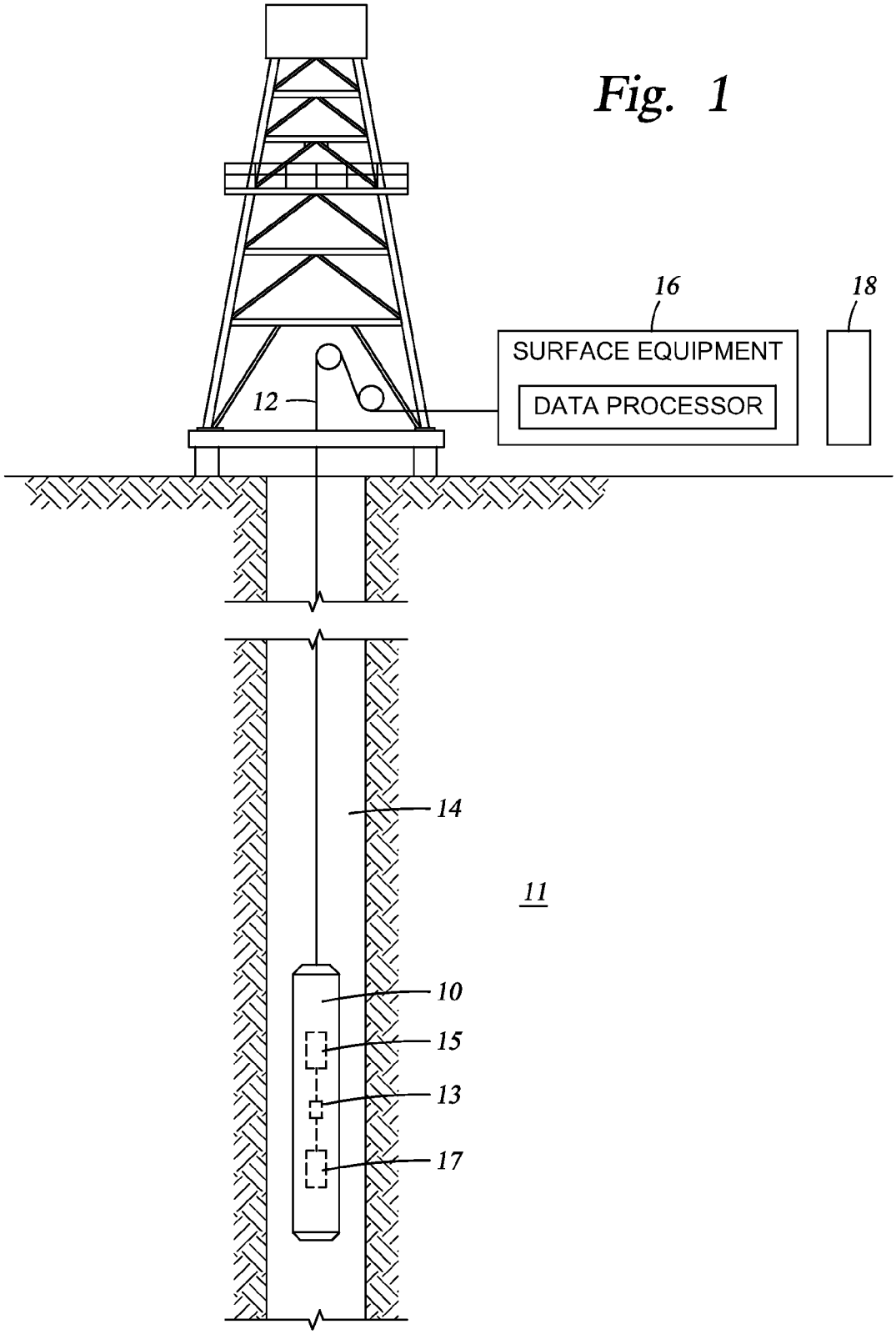
FIG. 1 is a schematic representation of a system deployed via a wireline in a wellbore and coupled to surface equipment.

Turning now to FIG. 1, the basics of a reservoir exploration (borehole logging) system are shown. A borehole tool or sonde 10 is shown suspended in a borehole 14 of a formation 11 by a cable 12, although it could be located at the end of coil tubing, coupled to a drill-pipe, or deployed using any other means used in the industry for deploying borehole tools. Cable 12 not only physically supports the borehole tool 10, but typically, signals are sent via the cable 12 from the borehole tool 10 to surface located equipment 16. In addition, cable 12 is often used to provide electrical power from the surface to the borehole tool 10. The surface located equipment 16 may include a signal processor, a computer, dedicated circuitry, or the like which is well known in the art. Typically, the equipment/signal processor 16 takes the information sent uphole by the borehole logging system 10, processes the information, and generates a suitable record such as a display log 18 or the like. Suitably, the information may also be displayed on a screen and recorded on a data storage medium or the like.

The borehole tool 10 may include at least a first fluid retrieval tool 15 which is capable of retrieving fluid from the formation. In the illustrated embodiment, the borehole tool 10 also includes a second fluid retrieval tool 17, which is also capable of retrieving fluid from the formation. The first and second fluid retrieving tools 15, 17 either include their own controllers or may be operably coupled to a central control system 13 which may include a processor (not shown). Alternatively and/or additionally, the retrieving tools 15, 17 are communicably coupled to the surface controller 16.

While the present disclosure is directed to techniques for retrieving formation fluid samples, those techniques may be carried out by any one or more of a variety of retrieving tools, such as a coring tool, a heating and sampling tool, or an injection and sampling tool. In one example, a coring tool, a heating and sampling tool, or an injection and sampling tool may be selectively included in the downhole tool 10 based on an estimate of one of the permeability of the formation 11, the viscosity of the formation 11, and the mobility of the fluid in the formation 11. The estimate of the mobility may be derived from logs or other formation data of the current well, logs or other formation data from other wells in the same reservoir, analysis of the cuttings obtained during the drilling of the current well or other wells in the same formation, or a reservoir model, if available. In another example, two or more of a coring tool, a heating and sampling tool, and an injection and sampling tool may be part of the downhole tool 10. One of the coring tool, the heating and sampling tool, and an injection and sampling tool may be selected downhole based on an estimate of the mobility of the fluid performed by the other of the coring tool, the heating and sampling tool, and an injection and sampling tool. It will be appreciated by those skilled in the art that by taking into account the characteristics of the particular formation or fluid to be sampled in the selection of the retrieving tool(s) implemented into the tool 10, the probability that at least a component of the downhole tool 10 expedites the sampling of the formation is increased.

Figure 2:
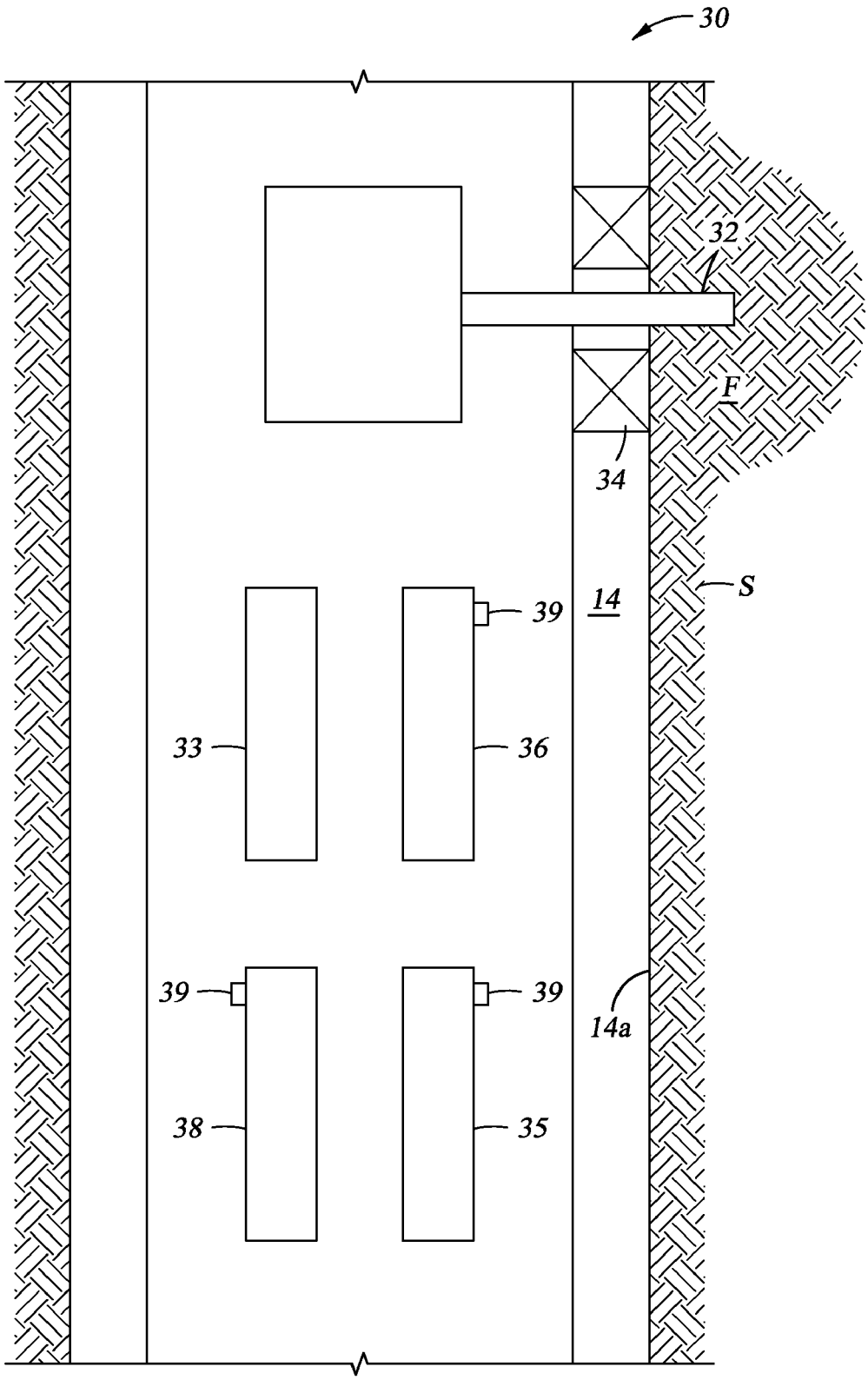
FIG. 2 is a high level schematic diagram of a coring tool including means for preserving core samples.

One of the first and second fluid retrieving tools 15, 17 may be provided as a coring tool, such as the exemplary coring tool 30 is illustrated in FIG. 2. The coring tool 30 includes a coring bit 32 for obtaining core samples from the formation. The coring bit 32 may be surrounded by an annular seal 34 and may be arranged to swivel from horizontal to vertical so that core holders containing cores (not shown) can be stored in a vertical storage rack 36. Once stored in the storage rack(s), the cores may be brought to the surface for analysis. Alternatively, the cores may be ground with a grinder 33 to obtain access to the formation fluid deposits, with the residual formation fluid being extracted and stored in a sampling chamber 38.

In other exemplary embodiments, the formation fluid may be extracted from the core(s) using one or more of a plurality of methods. For example, a heating unit 35 may engage or receive the core(s) and be adapted to reduce the viscosity of the heavy oil by increasing the temperature in and/or around the core. The heating unit 35 may produce heat using one or more of a chemical, resistive, radiant, and conductive apparatus, but may include others know in the art.

The core(s) and/or the formation fluid, whether ground or not, may also be tested for one of the many propertied or parameters discussed herein. For example, the core may undergo resistivity measurements. In order to obtain the desired parameter information, the coring tool 30 may include one or more sensors 39 that may be disposed proximate the sample chamber 38, the heating unit 35, and the storage rack, among others.

The coring tool 30 may be used to advantage for retrieving formation fluid from a formation adjacent of a wellbore. In some cases, the fluid is extracted downhole and stored in a sampling chamber 38, as mentioned above. Further, the coring tool 30 may seal the captured cores using methods known in the art. Still further, the coring tool 30 may include a refrigeration unit (not shown) to preserve the core or fluid samples for example by minimizing the mobility of the fluid trapped in cores. Thus, the core may be brought at the earth surface where the trapped fluid may be flushed and analyzed.

Instead of coring, the fluid retrieving tools may use injection to improve the mobility of the formation fluid while in the formation. Such injection and sampling tools may inject one or more of chemicals that may generate heat by reacting together, chemical that may react with the formation fluid (e.g. air, oxygen), oil, steam, water, hot fluid, solvent (e.g. carbon dioxide, nitrogen, methane, polar liquid hydrocarbon). Either one of the fluid retrieving tools 15, 17 may be selectively provided as an injection sampling tool.

Figure 3:
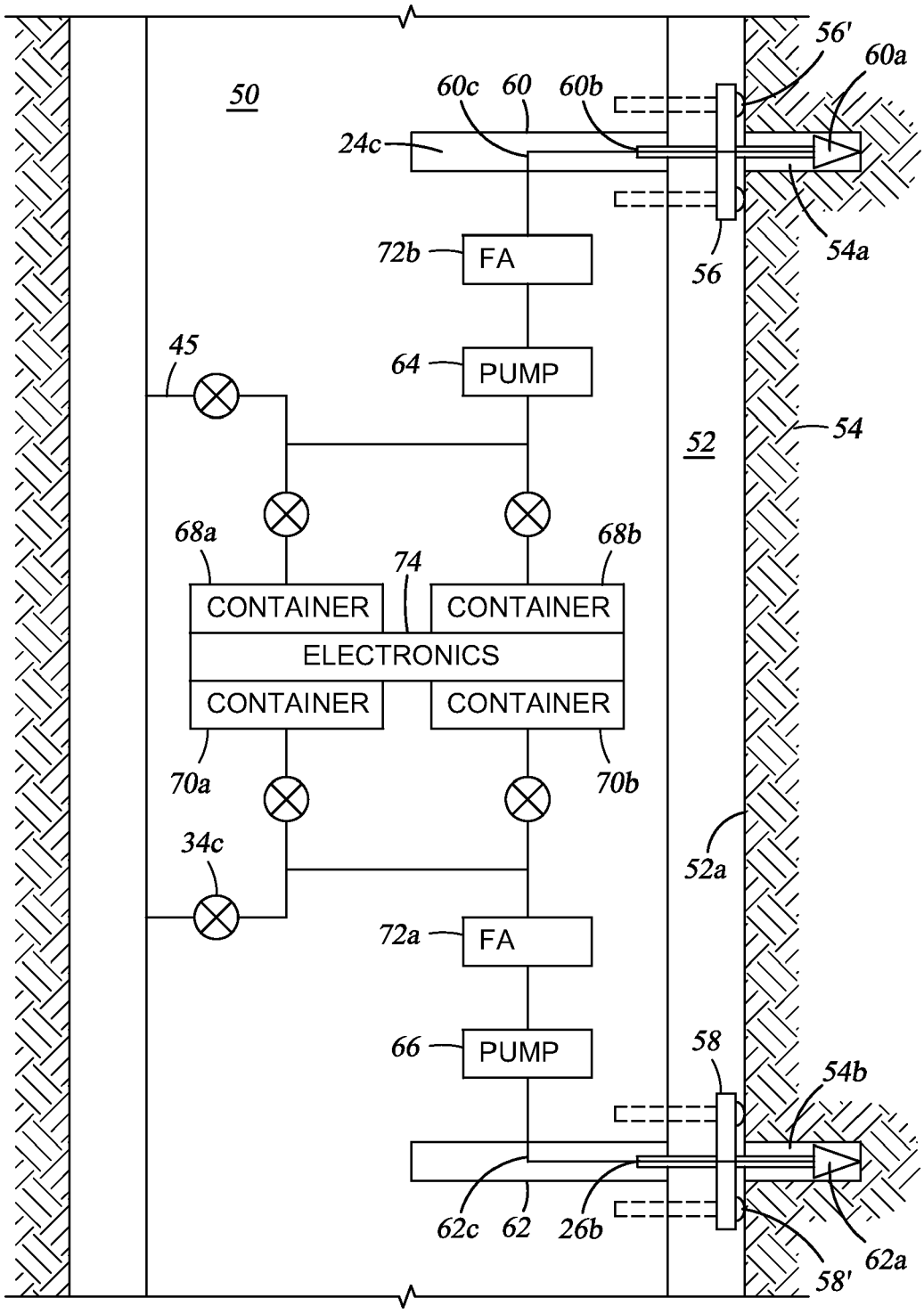
FIG. 3 is a schematic illustration of a sampling tool deployed downhole and being used according to some of the methods of this disclosure.

An exemplary injection sampling tool 50 that uses drilling means for injecting fluid is illustrated in FIG. 3 positioned in a borehole 52 of a formation 54. The tool 50 includes two probe assemblies 56, 58 which are extendable out of the tool toward the borehole wall 52*a*. Each probe assembly 56, 58 includes an elastic packer 56', 58' that surrounds a respective drilling means 60, 62. Suitable packers include packers as shown in U.S. Patent Application Pub. No. 2006/0000606 or U.S. Patent Application Pub. No. 2005/0279499. Alternatively or additionally, inflatable straddle packers (not shown) may be used that are able to isolate portions of the borehole 52. A suitable drilling means may be that found in the Cased Hole Dynamics Tester (CHDT) tool (see, e.g., "Formation Testing and Sampling through Casing", *Oilfield Review*, Spring 2002). It should be noted however that the tool 50, unlike the CHDT tool described above, may be used in an uncased borehole. The drilling means each include a drill bit 60*a*, 62*a*, a respective drill shaft 60*b*, 62*b*, and a flowline 60*c*, 62*c*. The flowline 60*c*, 62*c* may extend through the shafts 60*b*, 62*b*, as shows, but may have various other configurations. For example, the flowlines 60*c*, 62*c* may be disposed on a separate probe assemblies from the drilling means 60, 62 and/or may have an inlet disposed near the packers 56', 58'.

The flowlines 60*c*, 62*c* are coupled to respective pumps 64, 66. The pumps 64, 66 are coupled by respective flowlines and valves to fluid containers/sample chambers 68*a*, 68*b* and 70*a*, 70*b*, respectively. Optional fluid analyzers (FA) 72*a*, 72*b* may be coupled to flow line operatively associated with the pumps 66, 64 and are capable, among other things, of monitoring a property of the fluids drawn at the probes 58, 56 and/or monitoring a property of the fluids injected into the formation 54. The fluid analyzers 72*a*, 72*b* measure a fluid property in situ and may comprise one or more of a fluorescence sensor, an optical sensor, a pressure sensor, a temperature sensor, a resistivity and/or a conductivity sensor. Alternatively or additionally, the density and/or the viscosity of the fluid in the flow line may be measured by one or more sensors known in the art, including sensor(s) based on acoustic, vibrating mechanical object, or nuclear magnetic resonance (NMR) measurement principles. Electronics 74 are preferably provided to control the valves, the pumps and the drilling means, to communicate with surface equipment, and/or to analyze the contents of the fluid containers, etc, in conjunction with the optional fluid analyzers 72*a-b* and/or other sensors (not shown).

In operation, one or both of the probes 56, 58 may be extended out of the tool to engage the borehole wall 52*a*, and preferably seal one or more locations along the borehole wall. The drilling means 60, 62 are activated such that the drill bits 60*a*, 62*a* drill holes 54*a*, 54*b* through the isolated locations of the borehole wall 52*a* into the formation 54. When the tool 50 is so deployed, the flowlines 60*c*, 62*c* are in fluid communication with the holes 54*a*, 54*b* in the formation 54, and essentially sealed to the fluids in the wellbore. In one exemplary embodiment, the pump 64 may be activated so that the contents of the fluid containers 68*a* and 68*b* are pumped into the flowline 60*c*, through the probe 60 and into the hole 54*a*.

In other exemplary embodiments, the tool 50 may only include one drilling means and/or only one sampling means, which may or may not be disposed around the same probe assembly. For example, the tool 50 may inject fluid into the formation through a first probe assembly and retrieve the formation fluid through the same assembly. In short, the tool 50 is not limited to the embodiment disclosed above, but may have any other configurations using one or more of the components described above.

In one embodiment, the tool 50 uses a chemical reaction to generate a hot injection fluid. The contents of the containers 68*a* and 68*b* may be chosen so that they react with each other exothermically as disclosed in commonly-owned U.S. Ser. No. 11/562,908 which is hereby incorporated by reference herein in its entirety. The hot fluid enters the porous formation 54 and mobilizes formation fluids in its vicinity. Pump 66 is then activated to extract mobilized formation fluid from the hole 54*b*. The fluids extracted by pump 66 may be sent through the optical analyzer 72*a* to monitor one or more characteristics of the fluid.

Instead of using a chemical reaction, the tool 50 may generate in-situ (controlled) combustion by pumping air, oxygen, or a mixture thereof into one of the holes 54*a*, 54*b*. The injection rate of air or oxygen may be varied by the tool, for example to control the combustion rate. In addition, steam or water may also be pumped in the first hole for controlling the combustion front temperature. The combustion may consume some of the in-situ oil and produce heat, combustion gases and water vapor. Alternatively, or additionally, a hydrocarbon may be mixed into and injected with the air or oxygen. The injected mixture may also sustain a combustion process. The ratio of oxygen to hydrocarbon may be controlled so that the chemical composition of the mixture is within the combustion boundaries. The combustion products may reduce the viscosity of the oil and serve to drive the oil ahead of the combustion front, such as toward the second drilled hole where it can be pumped into the tool.

In a further alternative, the tool 50 may include a container 70*a* filled with a hot fluid or steam which optionally is generated downhole by heating elements (not shown) or by any technique described in previously incorporated Ser. No. 11/562,908. Alternatively, the hot fluid or steam may be generated uphole at the surface. The hot fluid is injected into the hole 54*b* and mobilized formation fluid may then be extracted from the hole 54*b* by reversing the pump 66. The fluids extracted from the hole 54*b* may then be analyzed in the fluid analyzer (FA) 72*a* over a period of time in order to determine whether they should be stored or dumped. For example, fluid initially extracted from the hole 54*b* may contain a significant amount of the injected fluid and that fluid may either be dumped into the borehole or re-injected into the formation. After a period of time, the fluid being extracted may be substantially pure formation fluid (defined herein as 90% or more pure). If it is desirable to sample the substantially pure formation fluid, that fluid may be fed to a previously empty container, e.g., container 70*b*.

The same tool 50 may further be used in a non-thermal process for retrieving fluid from a formation. For example, one of the containers 68*a-b*, 70*a-b* of the tool 10 may contain a mobility enhancer, such as by way of example and not limitation a miscible solvent such as a halogenated or otherwise polar normally liquid hydrocarbon, carbon dioxide, and most preferably a chlorinated solvent in which asphaltenes dissolve. Other containers may be used to collect mobilized formation fluid samples at different formation locations. For example, tool 50 can be set in the borehole and used to drill through the borehole wall into the formation to generate hole 54*a*. A mobility enhancer stored in container 68*a* can be injected into hole 54*a* through use of pump 64. After a period of time, if desired, pump 64 can be reversed, and mobilized formation fluid can be collected via hole 54*a* and stored in container 68*b* or dumped as desired, for example, based on information collected by the fluid analyzer (FA) 72*b*. At the same time, or at some other time earlier or later, the second pump 66 can be activated if desired in order to pull mobilized formation fluids from the formation at a second location removed from hole 54*b* via the probe 58. Again, these fluids can be stored or dumped as desired. After the desired sampling is completed, tool 50 can be moved to another location, and one or both of pumps 64 and 66 can be activated to pull yet additional formation fluids from the formation which may be have been mobilized via the injection of the mobility enhancer into hole 54*a*.

It can be appreciated that the tool 50 may be operated according to one or more operating parameters. These parameters include, but are not limited to, pumping rate, pumping differential pressure, injection rate, injection volume, injection fluid or medium, injection ratio of different fluids, drilled hole length and/or spacing. The value of the operating parameters may be varied between one formation and another, for example based on one of the mobility of the fluid in the formation, the permeability of the formation, or the viscosity of the formation fluid. These properties may be estimated from measurements performed before the tool 10 is lowered in the wellbore or by components of the tool 10. The values of the operating parameters of the tool 50 may be adjusted according to the latest or otherwise most reliable estimate of these properties, amongst other, as further detailed with respect to FIGS. 10A, 10B, 10C.

Instead of injecting, the fluid retrieving tools may use heat to improve the mobility of the formation fluid while in the formation. Such thermal sampling tools may use one or more of several heating sources, such as radio frequency (RF) heating, hot fluid, resistive heating, conductive heating, ultrasonic heating, or exothermic chemical reaction. Either one of the fluid retrieving tools 15, 17 may be selectively provided as a thermal sampling tool.

Figure 4:
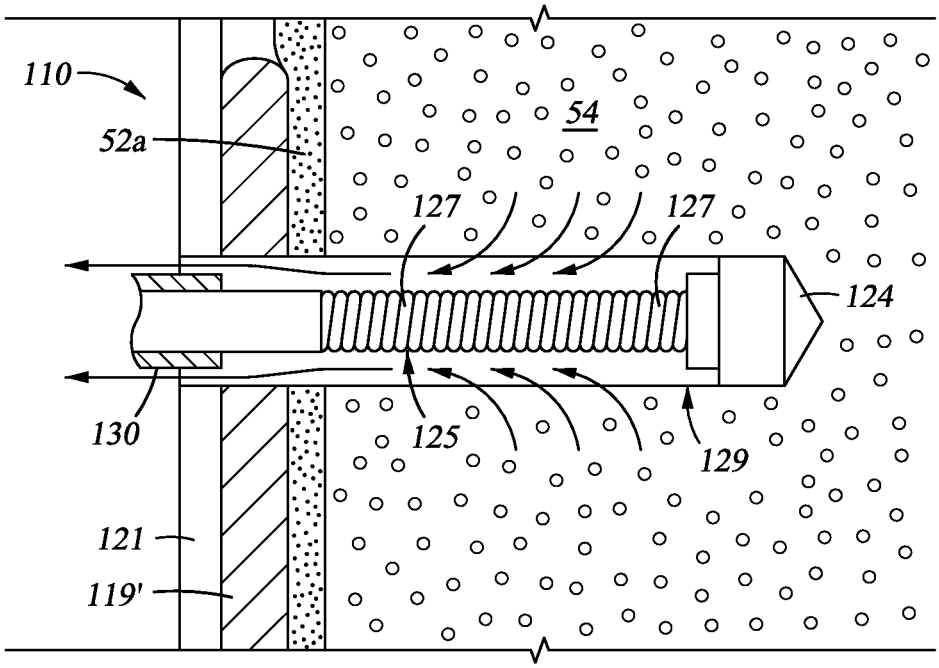
FIG. 4 is a detailed schematic illustration of a probe assembly of a tool having a heating element mounted on a drill shaft.

Another embodiment of a sampling tool having an extendable drill means is illustrated in FIG. 4. The sampling tool 110 includes a heating element 127 provided about a shaft 125. The heating element may comprise a resistive wire wound up around the shaft 125. The drill bit and shaft are surrounded by a seal 119 and a seal backing plate 121. A drill bit 124 extends out of the tool 110 while drilling a hole 129 through the mud cake on the borehole wall 52*a* into the formation 54. The drill bit may be piloted by the tool 110 using a shaft guide 130. It is also contemplated herein that the heating element 127 could be configured and activated in many ways. For example, the heating element may be an RF heating element, a resistive heating element, an ultra-sonic heating element, and/or a conductive heating element, and may not be attached to the drill shaft 125, but may be a wholly separate component. Accordingly, any of the contemplated configuration and activation methods may be implemented in various configurations of the before described tools. Some of these methods will be expanded upon below.

According to another alternate embodiment, the heating element 127 may comprise an antenna or coil which emits electromagnetic radiation. It should be noted that the frequency of the electromagnetic radiation can vary from kHz to GHz. The electromagnetic radiation power may be partially absorbed by the formation hydrocarbon fluid, connate water, or a fluid injected in the formation 54 by the tool 110. The frequency of the electromagnetic radiation may be selected by considering the following elements. The power absorption mechanism is typically dipole relaxation. Thus, the power absorption characteristics usually vary from fluid to fluid. The power absorption characteristics of a fluid are related to the complex electric permittivity of this fluid, which can be measured in a laboratory. The absorption maxima occur at approximately the frequencies corresponding to the maxima of the complex part of the permittivity. Also, it should be noted that the penetration of the electromagnetic wave decreases with increasing frequency, and that the absorption coefficient is approximately the reciprocal of the penetration depth and decreases as the frequency decreases. In some cases, the power absorption may be significant at frequencies coincident with an absorption frequency of a molecular mode of motion other than dipole relaxation.

In one example the coil is wound up around the shaft and generates current loops in the formation 54 that encircle the hole 129. According to another alternate embodiment, the heating element 127 may be replaced by an acoustic transducer (e.g. ultrasound) which stimulates the oil or adjacent fluid either directly or indirectly. For example, the ultrasonic transducer 127 may vibrate the drill bit 124 axially and generate acoustical waves in the formation 54.

According to one exemplary method, the tool 110 may be used to drill a hole 129 in the formation 54. The mobility of the oil in the vicinity of the hole 129 may be enhanced by delivering heat, and or vibrations to the formation 54, utilizing the element 127. For example, the heating element 127 can be activated through electrical control of the tool 110 and used as a mobility enhancer in order to expedite flow of formation fluids. As will be appreciated by those skilled in the art, formation fluids can flow through an annulus between the drill shaft 125 and the hole 129 into the tool 110. The seal 119 is preferably pressed against the formation for sealing the annulus from fluid in the wellbore.

Figure 5:
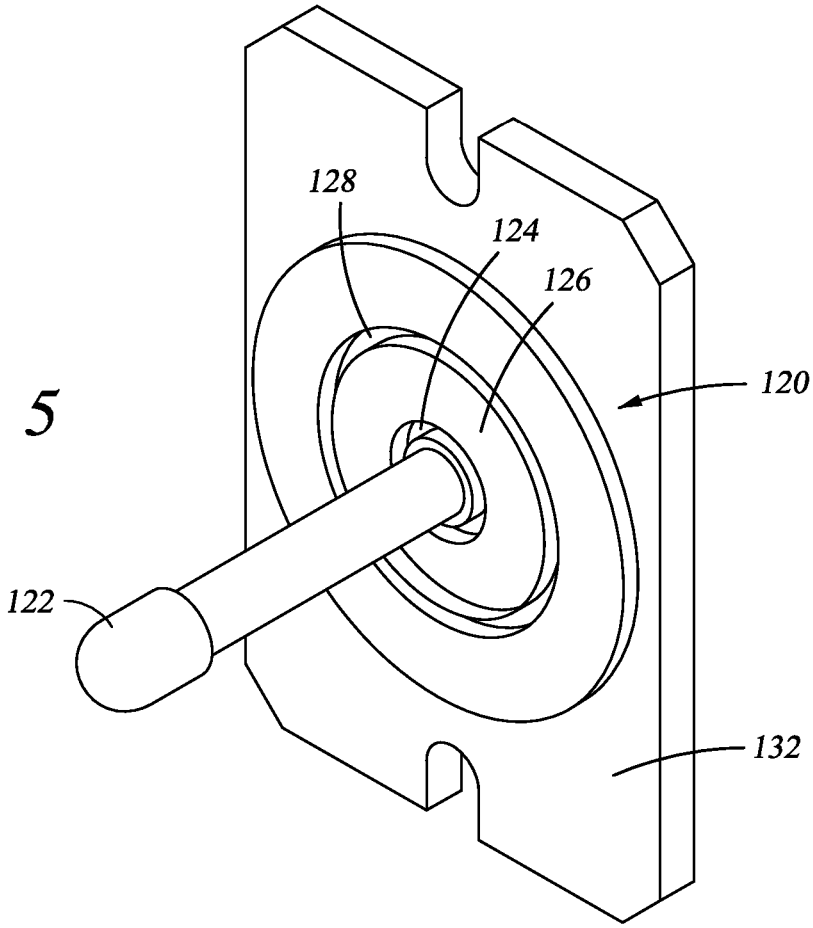
FIG. 5 is a schematic broken perspective of a packer portion of a tool having a guarded sampling packer around a drill shaft.

The probe or packer, as mentioned is any of the forgoing embodiments, may further include a guard for preventing contamination of the fluid samples retrieved from the formation. As illustrated in FIG. 5, a guarded probe 120 may be provided having a centrally positioned drilling element 122 which is surrounded by an annular sampling conduit 124. The drill and the sampling conduit are surrounded by a compliant isolation element 126 which serves to prevent hydraulic communication between the annular sampling conduit 124 and the annular guard conduit 128, and an outer isolation element 130, both of which are shown mounted on a backing plate 132. A hydraulic circuit which can be adapted to control the guarded probe 120 is shown in published U.S. Patent Application Pub. No. 2006/0042793.

Figure 6:
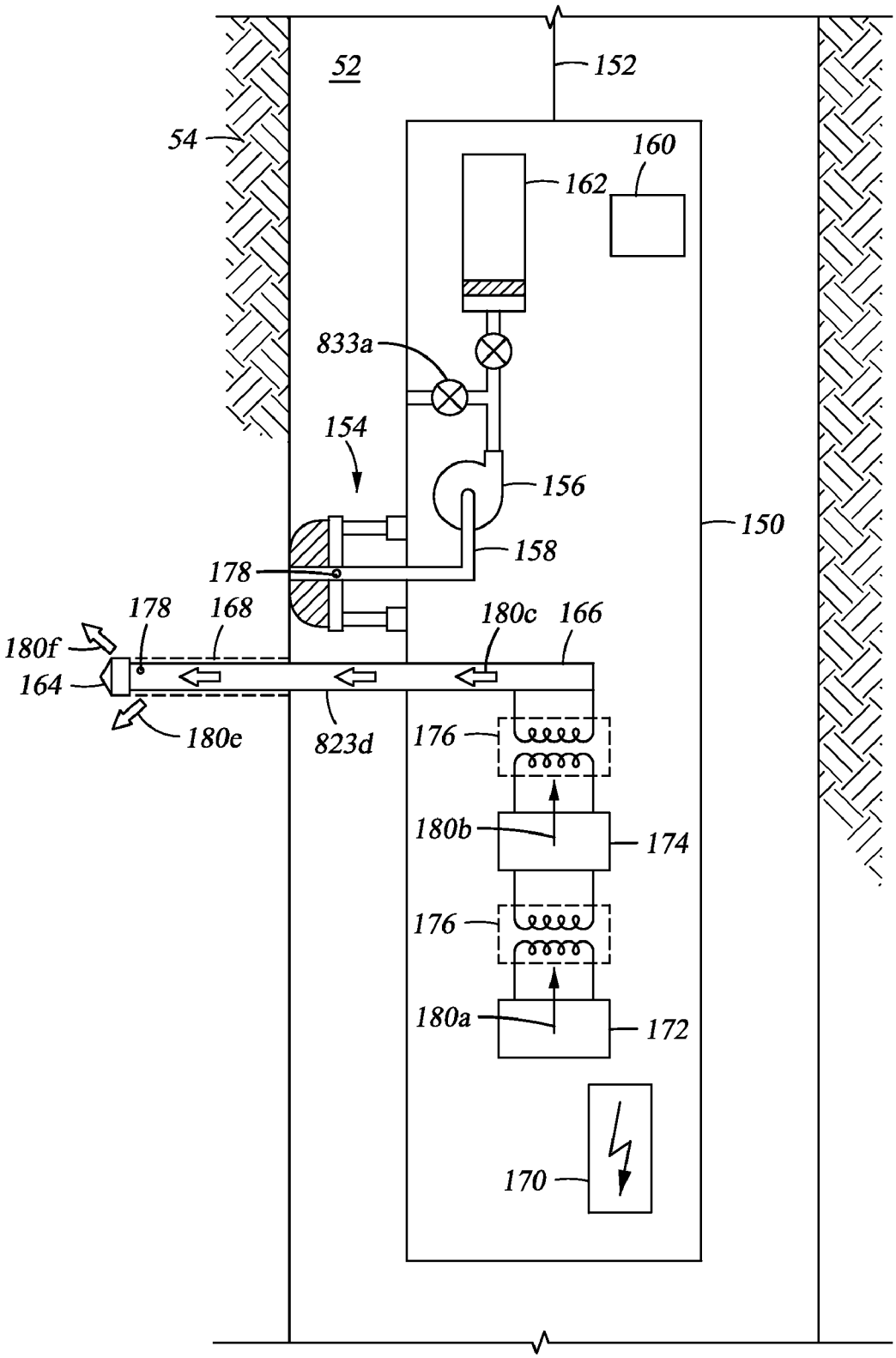
FIG. 6 is a schematic illustration of a sampling tool capable of enhancing the mobility of a reservoir fluid by delivering heat from a heat source.

Referring now to FIG. 6, another sampling tool capable of delivering heat for enhancing formation fluid mobility is described in further detail. The tool 150 is conveyed downhole with a wireline cable 152. The tool 150 includes a sampling system. As shown, the sampling system may comprise at least an extendable probe 154 for establishing a fluid communication between the formation 54 and the tool 150. A downhole pump 156 is hydraulically coupled to the probe 154 via a flowline 158. The pump 156 may be used to advantage for lowering the pressure in the flowline 158 below the formation pressure, while maintaining the pressure at the pump outlet above the wellbore pressure. Valves are communicatively coupled to a controller 160 and are selectively actuated to route the fluid to either dump into the borehole 52 or to discharge into a fluid container 162. The tool 150 may also includes a drill bit 164 mechanically coupled to a drill shaft 166. The drill shaft 166 is operated via a motor (not shown) to drill a hole 168 in the formation 54. The motor may be powered by a downhole battery 170, or via the wireline cable 152, or a combination thereof. In these embodiments, the hole 168 may be used for delivering heat deeper into the formation 54, and thus, enhancing the oil mobility in a region adjacent to the sampling probe 154, expediting thereby the sampling process.

The tool 150 is configured for delivering heat to the formation 54 by thermal conduction. The tool 150 comprises a heat source 172. The heat source 172 may be a resistive heater powered by any of the current provided by the wireline cable 152 or the battery 170, a chemical reactor where an exothermic chemical reaction is conducted, or some power electronics in the tool 150, for example the power electronics powering the pump 156. Optionally, the heat flow from the heat source 172 may be controlled by using a heat pump 174, thermally coupled to the heat source 172 and to the drill shaft 166 via optional heat exchangers 176. The heat pump 174 may be communicatively coupled to the controller 160 that controls the heating process based on temperature measurement(s) provided by one or more sensor(s) 178. Alternatively, the measurements of sensor(s) 178 may be telemetered to the surface via wireline cable 152, where they can be utilized by a surface controller or a surface operator for monitoring and controlling the heating and/or sampling process. In this embodiment, the drill shaft 166 preferably comprises a portion made of a good thermal conductor (not separately shown), for example copper or aluminum. This thermal conductor may further comprise a working fluid, for example water, and may operate as a heat pipe. Heat generated at the heat source 172 may then be delivered to the formation 54 by following the schematic path shown by arrows 180*a* to 180*f*. The heat delivered to the formation increases the temperature of the oil in the formation. The temperature increase of the oil translates into a viscosity decrease and thus a mobility enhancement. The mobilized oil may be sampled by probe 154 and stored in fluid container 162 and brought to surface, for example for further analysis. Alternatively, the tool 150 may be modified to deliver heat to the formation 54 by thermal convection.

Figure 7:
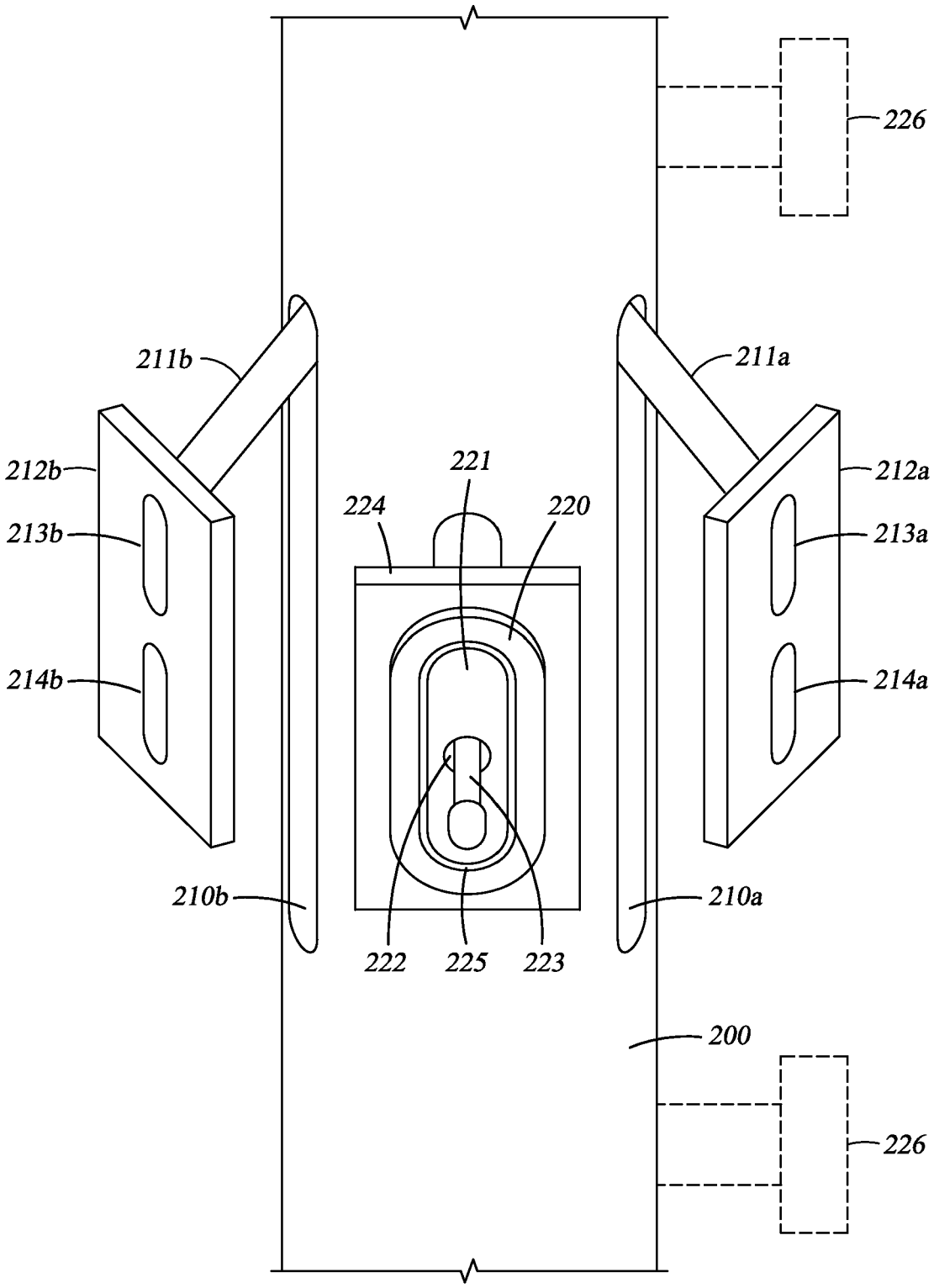
FIG. 7 is a schematic illustration of a packer portion of a tool capable of enhancing the mobility of a reservoir fluid by delivering heat with one or more electrodes.

Yet another alternative sampling tool 200 may propagate current or an electromagnetic wave in the formation 54. As shown in FIG. 7, the tool 200 may include articulated pads 212*a* and 212*b*. These pads may be placed against the formation 54 by the tool 200, using known deployment means, such as arms 211*a* and 211*b*, respectively. When not used, the pads are preferably recessed below the outer surface of the tool, for example in apertures 210*a* and 210*b* in the tool body. As shown, the pads may include a plurality of electrodes such as electrodes 213*a*, 214*a* on pad 212*a* and electrodes 213*b* and 214*b* on pad 212*b*. In one embodiment, the electrodes on each pad may be kept at the same potential, a potential difference is applied between the group of electrodes on one pad and the group of electrodes on another pad. This potential difference may be constant or may vary with time, and is provided by an electrical power source at surface or in the tool 200. Thus, current flows between two or more pads, at least in part in the formation 54. In another embodiment, a potential difference is applied between electrodes on a same pad. Thus, current flows between electrodes as desired. In both embodiments, the current may flow preferably in the invaded zone of the formation, especially if the mud filtrate has a better conductivity than the oil in the formation. In some cases, the current flow generates heat in the formation. The mobility enhancer is heat that is introduced into the formation by thermal conduction or thermal convection if fluids in the formation are displaced, for example when injection from the tool is also used.

The tool 200 is also provided with an extendable probe 220 for establishing a fluid communication between the tool and the formation. The probe may be detachably coupled to a backing plate 224 for facilitating the replacement thereof. The probe 220 may be made of a resilient material, and may comprise an internal support 225 for preventing deformation of the probe seal under pressure differential between the wellbore and the tool. The probe is also provided with a recess 221 and a port 222 for the flow of fluids into the tool when the probe is applied against the borehole wall. The probe is provided with a drilling means 223, for drilling a hole in the borehole wall. The hole may be used for facilitating the injection of fluids from the tool 200 or for drawing formation fluid into the tool 200 and capturing a sample. In particular, fluid may be injected in the formation for modifying locally the resistivity of the formation and improving the efficiency of the heating via pads 212*a* and/or 212*b*.

Although shown with electrodes, the pads 212*a* and 212*b* may alternatively comprise any of electromagnetic antenna (e), acoustic transmitter(s), resistor(s) or other element(s) for generating heat. Further, the heating pads can be configured with one or more inlets through which a hole is drilled into the formation. The inlet may be in fluid communication with the tool so that the formation fluid can be sampled. Also, the heating elements, or electrodes, on the pad are preferably arranged so that the depth to which the heat is able to penetrate into the formation is sufficient for mobilizing a volume of oil corresponding to the sampling requirements. The heating elements, or electrodes, on the pad are not limited to two per pad. Similarly, any number of pads may be used and the tool 200 is not limited to two pads.

Instead of electrodes, the tool 200 may include induction coils to deliver current to the formation by induction. Still further, the tool 200 may include some other energy source, such as an ultrasonic emitter, to generate heat in the formation. Details on these and other alternatives are provided in U.S. patent application Ser. No. 11/763,237 filed on Jun. 14, 2007, the content of which is incorporated herein for all purposes.

Although various embodiments are discussed herein with association to the articulated arms 211*a* and 211*b*, and the pads 212*a* and 212*b*, it is contemplated that heating of the formation may be accomplished without the use of the arm and pads. For example, the various exemplary heating methods may be employed while the heating apparatus is in the tool or affixed to the tool. In addition, the heating apparatuses need not be extendable from the tool as long as heating of the formation is accomplished. For example, it is contemplated that the tool may include backup pistons 226 for forcing the heating apparatus(es) against the formation. It is similarly contemplated that the heating apparatus(es) do not abut the formation, but rather heat the wellbore fluid disposed between the heating apparatus(es) and the formation, as well as the formation itself.

It should be noted that the heating and sampling tools of FIGS. 4-7 may be operated according to one or more operating parameters. These parameters include, but are not limited to, pumping rate, pumping differential pressure, amount of heat emanating the heating mechanism, amount of energy provided to the heating mechanism, and distance the heating mechanism extends into the formation. The value of the operating parameters may be varied between one formation and another, for example based on one of the mobility of the fluid in the formation, the permeability of the formation, and the viscosity of the formation fluid. The values of the operating parameters of the heating tool may be adjusted according to the latest or otherwise most reliable estimate of these properties, amongst other, as further detailed with respect to FIGS. 10A, 10B, 10C.

It should be appreciated that the fluid retrieving tools of the present disclosure may be implemented, if desired, in combination. Thus, the first and second fluid retrieving tools 15, 17 of FIG. 1 may be operatively coupled in one device. For example, a coring tool may be combined with a sampling tool, or an injection tool, as shown in published U.S. Patent Application Pub. No. 2005/0284629. Another example is further detailed below with respect to FIG. 8.

Figure 8:
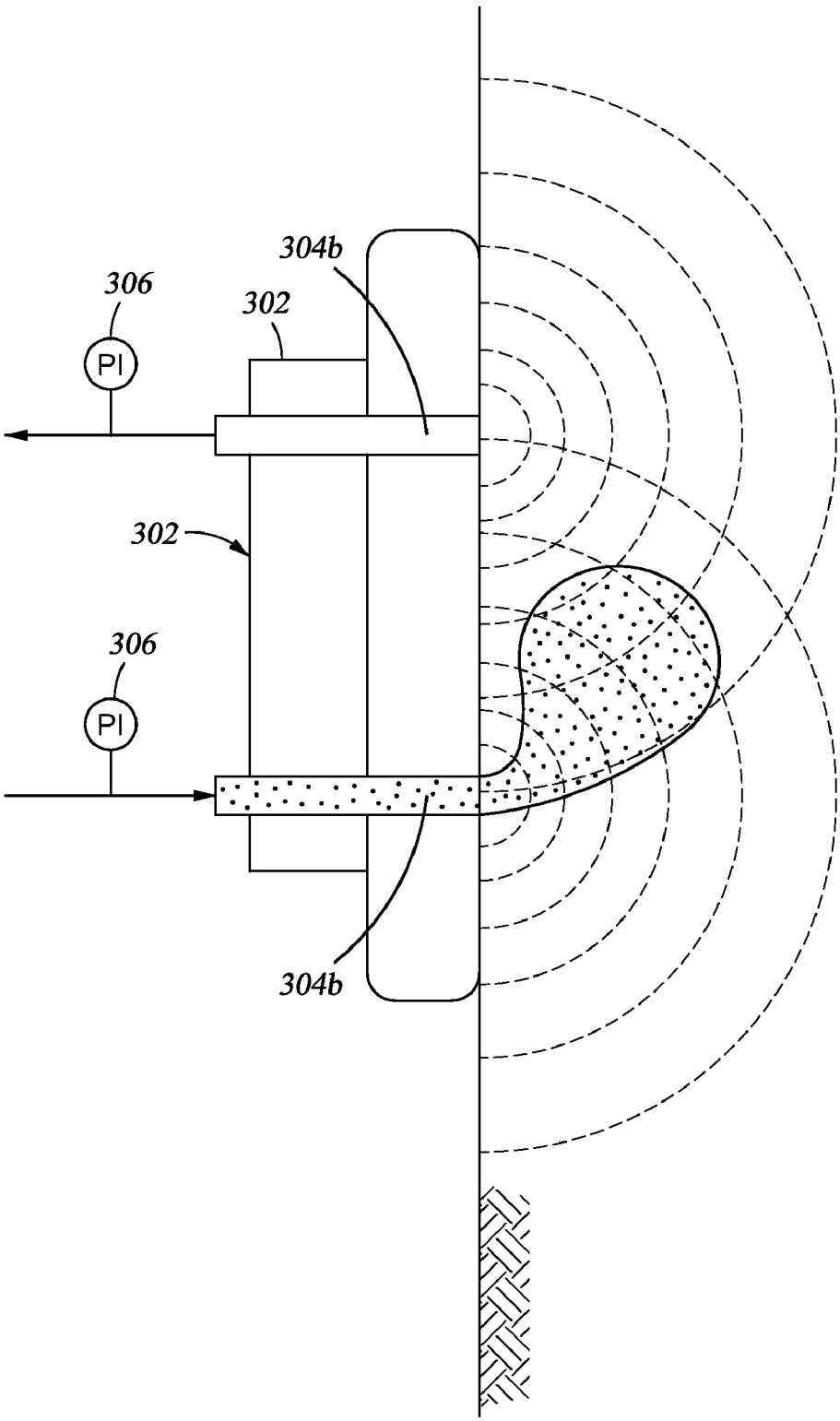
FIG. 8 is a side elevation view of pressure and temperature gauges attached to injection and production flowlines.

An alternative sample tool 300 reduces oil viscosity by heating a small volume of the formation near the wellbore using AC current, and may further pressurize the heated heavy oil by injecting fluid into the formation. As shown in FIG. 8, the sampling tool 300 includes a probe 302 having two formation interfaces 304*a*, 304*b* connected to different flowlines, which allow for injection of a buffer fluid into the formation from one interface 304*a* and retrieval of reservoir fluid from the other interface 304*b*. Exemplary buffer fluids include nitrogen, carbon dioxide, and polar fluids like dibromoethane. The buffer fluid composition and/or the injected quantity of buffer fluid should be selected so that it does not stimulate asphaltene precipitation. An electrode may be associated with each interface 304*a*, 304*b* for generating an alternating current that heats the formation. Alternatively, electrodes may be positioned at points along the probe and oriented to propagate alternating current into the formation. Pressure and temperature gauges 306 may be attached to flowlines associated with the interfaces 304*a*, 304*b* to monitor the differential pressure at the sand face, the drawdown pressure, and the local formation temperature, which may be used to interactively control the process. Additional details regarding the sampling tool 300 and alternatives are provided in U.S. patent application 60/885,250 filed on Jan. 17, 2007, the content of which is incorporated herein for all purposes.

Figure 9:
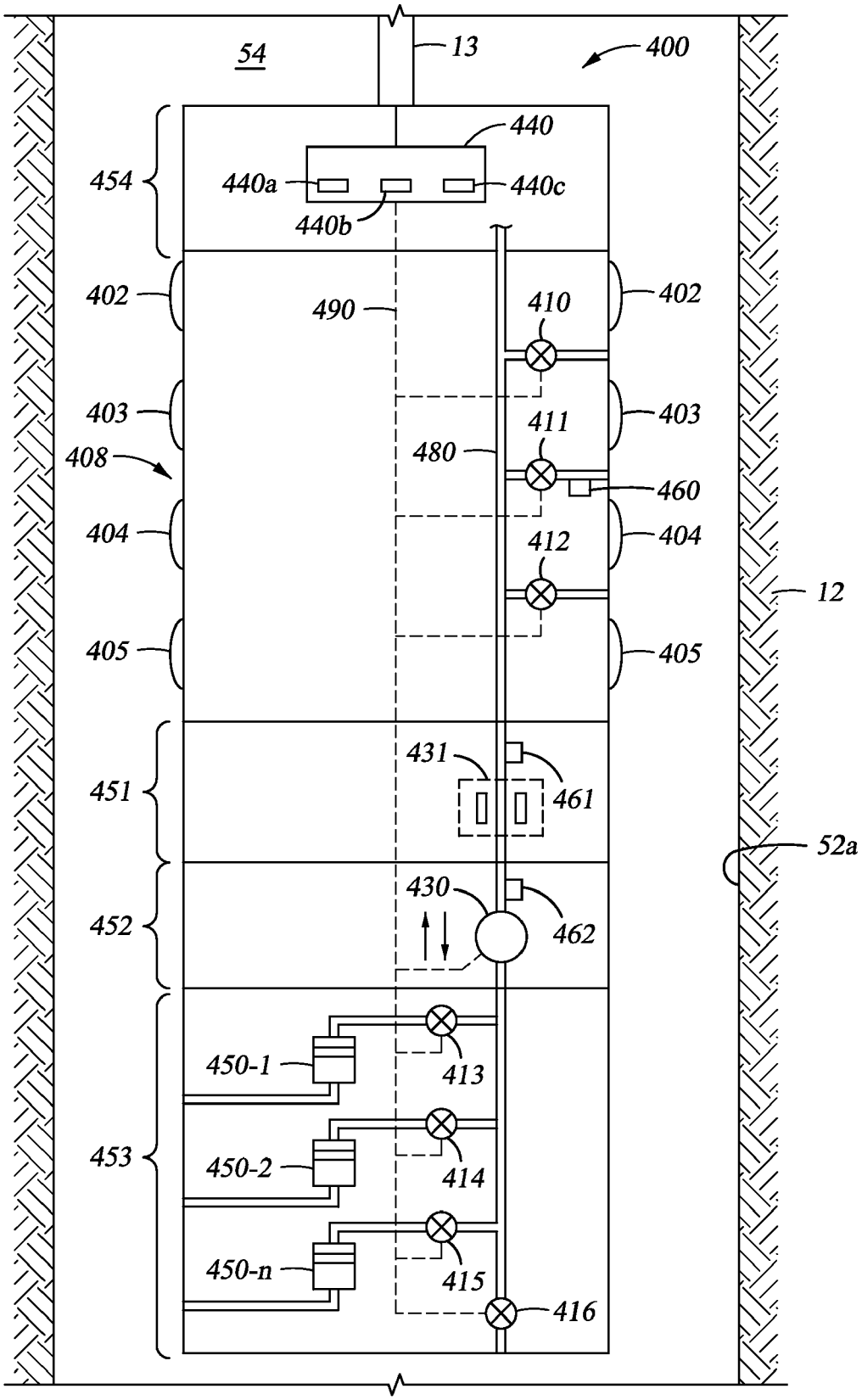
FIG. 9 is a schematic showing one embodiment of a testing tool capable of sealing wellbore intervals of various lengths.

While the foregoing exemplary sampling tools include the use of an extendable probe having a seal, an alternative sampling tool 400 uses expandable packers to seal off sections of the borehole. As best shown in FIG. 9, the sampling tool 400 is built in a modular fashion, with telemetry/electronics module 454, packer module 408, downhole fluid analysis module 451, pump module 452, and carrier module 453. Telemetry/electronics module 454 may comprise a controller 440, for controlling the tool operation, either from instructions programmed in the tool and executed by processor 440*a* and stored in memory 440*b*, or from instruction received from the surface and decoded by telemetry system 440*c*. Controller 440 is preferably connected to valves, such as valves 410, 411, 412, 413, 414, 415 and 416 via one or more bus 490 running through the modules of tool 400 for selectively enabling the valves. Controller 440 may also control a pump 430, collect data from sensors (such as optical analyzer 431), store data in memory 440*b* or send data to surface using telemetry system 440*c*. The fluid analysis module 451 may include an optical analyzer 431, but other sensors such as resistivity cells, pressure gauges, temperature gauges, may also be included in fluid analysis module 451 or in any other locations in tool 400. Pump module 452 may comprise the pump 430, which may be a bidirectional pump, or an equivalent device, that may be used to circulate fluid along the tool modules via one or more flow line 480. Carrier module 453 can have a plurality of cavities, such as cavities 450-1, 450-2, to 450-*n* to either store samples of fluid collected downhole, or transport materials from the surface, as required for the operation of tool 400. Packer elements 402, 403, 404 and 405 are shown uninflated and spaced along the longitudinal axis of packer module 408. Although not shown, the packers extend circumferentially around tool 408 so that when they are inflated they will each form a seal between the tool and the borehole wall 52*a*.

Also shown on FIG. 9 are particle breaking devices 460, 461, or 462. These particle breaking devices could be focused ultrasonic transducers or laser diodes. Particle breaking devices are preferably used to pulverize sand, or other particles passing into the flow lines, into smaller size particle, for example, for avoiding plugging of component of the testing tool. These devices may use different energy/frequency levels to target various grain sizes. For example, particle breaking device 462 may be used to break produced sand during a sampling operation. In some cases, the readings of downhole sensor 431 will be less affected by pulverized particles than larger size particles. In some cases, pump 430 will be able to handle pulverized particles more efficiently and will not plug, leak or erode as fast as with larger size particles in the mud. Particle breaking devices may be used for other applications, such as transferring heat to the flow line fluid.

In operation, the tool 400 is positioned in the borehole and selected packer elements are inflated to isolate a portion of the borehole. Access into the formation fluid may further require perforation into the borehole wall, which may be achieved using any known perforation means. Fluid samples may then be retrieved and stored in one or more cavities 450-1, 450-2, 450-*n*.

It should be appreciated that the length of the portion of the wellbore wall that is isolated between two extended packers may be adjusted by selectively inflating two of the four packers of the tool 400. For example, a large length may be achieved by inflating packers 402 and 405, or a short length may be achieved by inflating packers 403 and 404. The length of the isolated portion of the wellbore may be varied between one formation and another, in particular based on one of the mobility of the fluid in the formation, the permeability of the formation, and the viscosity of the formation fluid. Similarly, the tool 400 may comprise a plurality of probes (not shown) having different dimensions. One of the probes may be selectively extended towards the wellbore wall.

In an alternate embodiment, one or more of the packer elements 402, 403, 404 and 405 may be movable relative to the tool 400. This embodiment provides the added benefit of adjusting the relative spacing of the packers to enable optimal fluid communication with the formation and/or optimize sampling. Additional details of the various embodiments and features of the tool 400 are provided in U.S. patent application Ser. No. 11/693,147 filed on Mar. 29, 2007, the content of which is incorporated herein for all purposes.

According to certain aspects of the present disclosure, one or more characteristics of the formation and/or the fluid are estimated to select a suitable retrieval method and apparatus. The characteristics of the formation and/or fluid are monitored and operation of the selected method may be altered based on that feedback. Additionally or alternatively, a second retrieval method or apparatus may be selected based on the feedback, in which case the first retrieval method is ended and the second retrieval method is initiated. A downhole tool may include apparatus for carrying out both the first and second retrieval methods. For example, a single device may include the first retrieving tool 15, which may comprise a first type of retrieving tool, and the second retrieving tool 17, which may be a second, different type of retrieving tool. Such a device would allow the first and second sample methods to be performed without tripping the device.

Figure 10A:
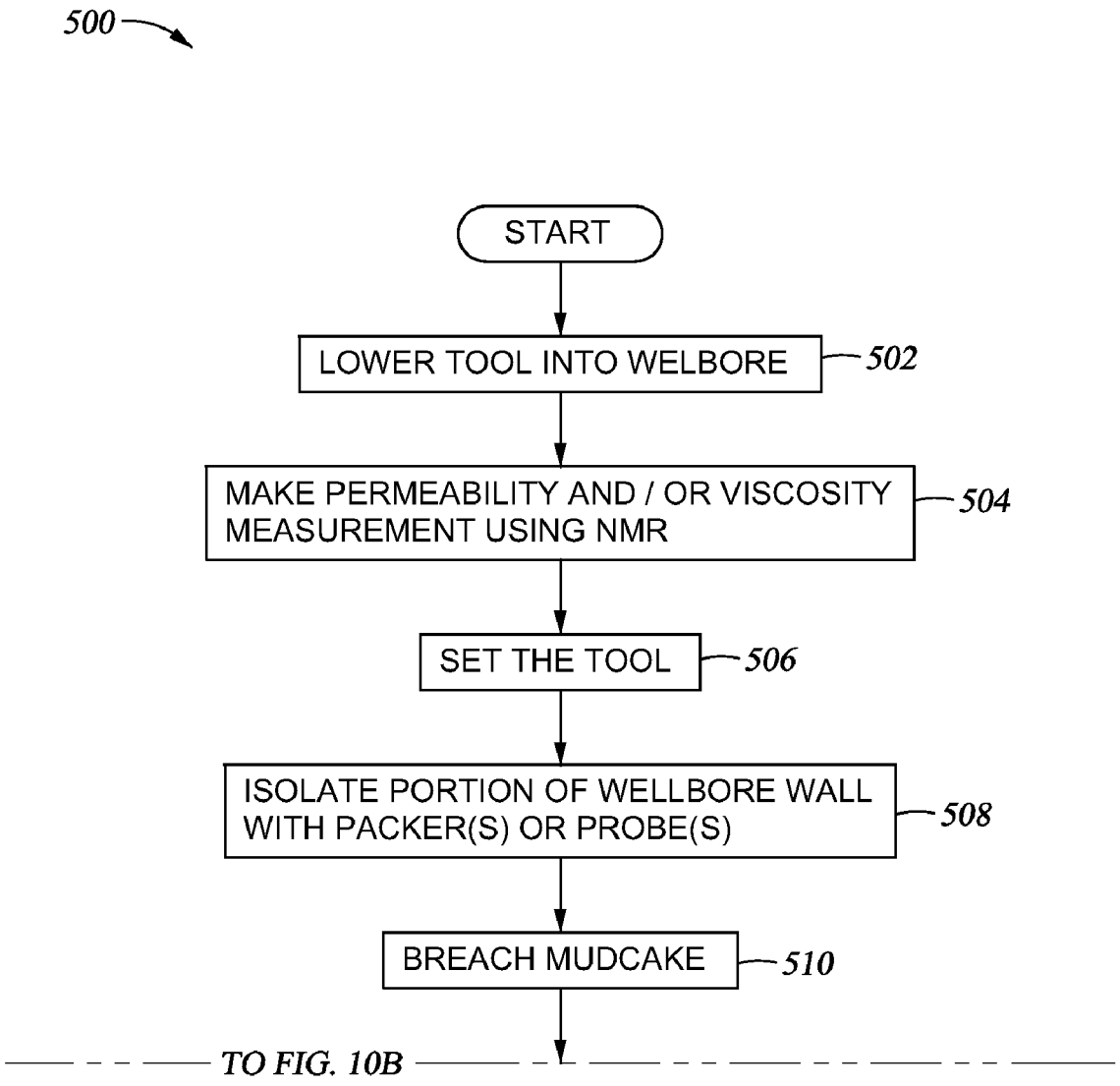
FIGS. 10A-C show a schematic flowchart illustrating a method of retrieving a fluid sample from a formation.
Figure 10B:
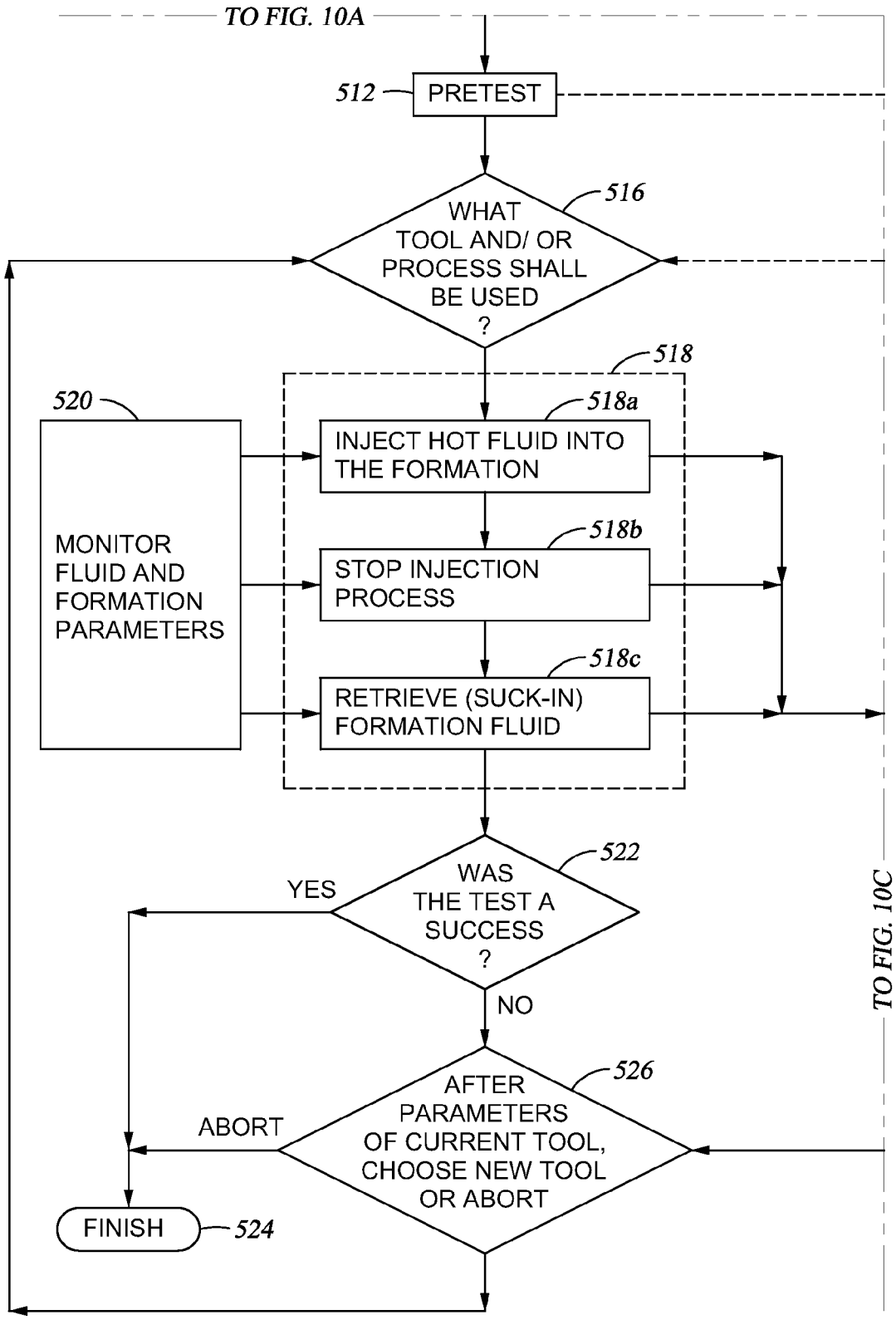
Figure 10C:
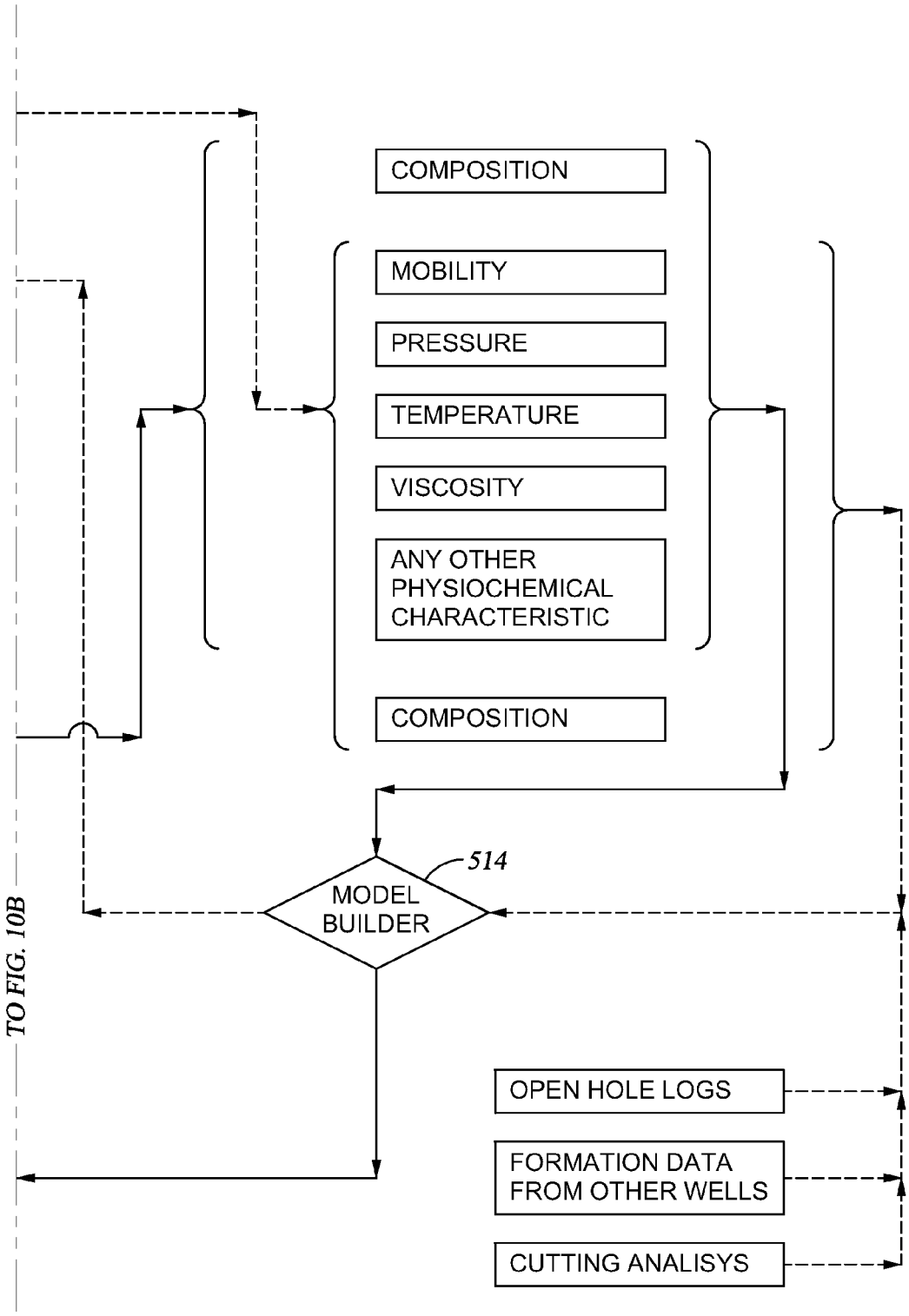

An exemplary method 500 of retrieving a formation fluid is illustrated in the flow chart presented at FIGS. 10A, 10B and 10C. Referring to FIG. 10 A, the method is initiated at block 501 by collecting prior information. In one example, some knowledge of the reservoir hydrocarbon (e.g. viscosity) and/or the formation rock (e.g. permeability) to be sampled may be available from various sources, such as logs, formation data or cutting analysis of the current well; logs, formation data or cutting analysis of from other wells proximate of the current well; a reservoir model, etc. This information may be interpreted to determine relevant reservoir characteristics. The reservoir characteristics preferably include one of an estimated mobility of the fluid in the formation to be sampled, an estimated viscosity of the fluid to be samples and an estimated permeability of the formation to be sampled. However, other reservoir characteristics may also be determined from the prior information. The determined reservoir characteristics are sent to the model builder 514 of FIG. 10C.

Additional data may also be sent to the model builder 514. Additional data may include information about the economics of oil production, such as the retail price of oil, the availability of refinery plant close to the well, etc. The information collected by the model builder may be used for generating recommendations about the sampling process upon request, as further detailed below.

In one example, the prior information may be used, e.g. by the model builder 514, to guide the selection of the most appropriate methodology for sampling, or in other words, to guide the selection of retrieval tools/methods. In particular, if an oil having an estimated viscosity in the range between around 100 and around 1,000 mPa·s is to be retrieved, a retrieval tool may comprise a heating and sampling tool only. If an oil having an estimated viscosity in the range between around 1000 and around 10,000 mPa·s is to be retrieved, a retrieval tool may comprise an injecting and sampling tool only. Furthermore, if the presence in the fluid to be retrieved of asphaltene or other chemical is suspected, one or more compatible solvent may be chosen accordingly and placed in the injecting tool. On the other hand, if an oil having an estimated viscosity above around 10,000 mPa·s is to be retrieved, a retrieving tool may comprise a coring tool only.

At block 502, a retrieval tool is assembled and lowered into the wellbore. In one example, the retrieval tool is assembled based on recommendations provided by the model builder 514. In another example, little may be known about the oil to be retrieved. Because the viscosity of reservoir fluids such as heavy oil may cover four orders of magnitude, and because the composition of reservoir fluid may include components that precipitate with particular fluids that are injected in the formation, the tool may implement a plurality of retrieving methods/apparatuses. The tool may implement, amongst other combinations, an injecting tool with a plurality of solvents, or a heating, injecting and sampling apparatus. Thus, the probability of capturing an oil sample by at least one of the retrieving methods/apparatuses implemented in the tool is increased. The plurality of methods/apparatuses may be attempted simultaneously and/or sequentially, as is further detailed below. The retrieval tool is incorporated into a tool string. The tool string may be conveyed downhole with any conveyance means known in the art. In some examples, the retrieval tool may be part of a drill string used to drill the wellbore.

At block 504, a permeability and/or viscosity measurement is made by a formation evaluation tool that is part of the same tool string as the retrieval tool. The measurement may be provided by using nuclear magnetic resonance (NMR) for example. This measurement may be used to advantage for updating the knowledge of the fluid in the reservoir, or for selecting a particular sampling location in the reservoir. The values of the measured permeability and/or viscosity are preferably sent to the model builder 514. Those skilled in the art will appreciate that while a permeability and/or viscosity measurement is described, other measurements performed by formation evaluation tool part of the same tool string as the retrieval tool may also be sent to the model builder.

The tool is then set in place at block 506. This step may include actuating backup pistons, extending probes, or other measures to secure the position of the tool within the borehole. With the tool set in place, the isolation of portions of the borehole may commence. With the tool positioned in the borehole, a portion of the borehole wall is isolated at block 508. The wall portion may be isolated by the seal of a probe that is extended into contact with the wall, by two or more packers that are expanded to engage the wall, or by any other known means. If the borehole has a mudcake layer, then the mudcake layer is breached at block 510 to gain access to the formation. It is possible that the borehole does not have a mudcake layer, in which case this step may be omitted. It is also possible that the wellbore is cased, in which case the block 510 corresponds to perforating the casing for accessing the formation.

The tool then performs a pretest at block 512. In the pretest, the tool uses one or more sensors to measure characteristics of the formation and/or the fluid while a small volume of fluid is withdrawn from the formation. During the pretest, data regarding pressure, temperature, or any other relevant characteristic may be obtained and forwarded to the model builder 514. The pretest data may be used to estimate a mobility range of the formation fluid, the reservoir temperature and the reservoir pressure. Additionally or alternatively, the tool may perform a fluid compatibility test at block 512. Additional details regarding fluid compatibility are provided in U.S. patent application Ser. No. 11/746,201 filed on May 9, 2007, the content of which is incorporated herein for all purposes. Fluid compatibility test data may be used to identify potential interference between injection fluids and the reservoir fluid, such as asphaltene precipitation, formation of emulsions, and the like.

The method 500 uses a model builder, indicated at block 514 of FIG. 10C, which generates a model of the formation and fluid. The model represents the physics of a sampling process, including the transport and the hydrodynamics of the reservoir near the sampling point. The model may further include a thermodynamic model of the sampled fluid, e.g. fluid viscosity as a function of temperature and/or solvent concentration, and a fluid phase diagram. As desired, fluid phase diagrams may include one or more of upper and lower asphaltene flocculation lines, waxes precipitation loci, gas to liquid phase boundaries, etc. The model may be utilized for predicting the likely outcome of any sampling operation, such as heating the formation for a determined time, injecting a determined quantity of solvent, fracturing the formation, and the like. It should be understood that because the chemical composition of the oil as well as the permeability, anisotropy and consolidation of the formation are initially not well known, the predictions may not be accurate. However, the parameters of the model builder (mobility, reservoir pressure, fluid composition, etc.) may be updated as the sampling process(es) unfolds, for example using adaptive algorithms known in the art. In particular, an initial estimate of the parameters of the model may be derived from received pretest information, received NMR information, and other relevant information including any data obtained from previous operations such as any open hole logs, formation data from the current or other nearby wells, and cutting analysis.

The model may be used to predict the formation/formation fluid response in light of a particular sampling operation. Sensors are preferably spatially distributed and include for example pressure sensors, temperature sensors, viscosity sensors, flowrate sensors, or fluid spectrometers. As the operation unfolds, the response measured by the tool sensors is compared to the response predicted by the model. The parameters of the model may then be iteratively adjusted so that the measured response and the predicted response reasonably agree.

Continuing to FIG. 10B, the model builder 514 is interrogated at block 516. It will be appreciated that each of the various retrieving tools/methods may be more suitable for particular formation/fluid environments. Accordingly, the first retrieving tool/method is selected in a first example from the available tools/methods according to its suitability for the particular formation/fluid environment as estimated by the model builder and associated data. The selected tool/method may be any one of the known retrieving tools/methods, including those described above. Accordingly, the first retrieving tool/method may be a coring tool/method, a heating and sampling tool/method, an injection and sampling tool/method, or other technique. As noted above, the heating tool may generate thermal energy using RF, hot fluid, resistive heating, conductive heating, convection heating, combustion, ultrasonic waves, chemical reaction, or other heating means. The injection techniques may be non-thermal, and may involve injecting a miscible or immiscible solvent into the formation. Furthermore, a retrieving tool may combine elements of the heating, injection, and coring techniques without departing from the scope of this disclosure. In a second example, a first retrieving tool/method is selected based on a desired objective, such as capturing a representative sample in a minimum amount of time given the limitation of the tool (e.g. power), capturing a representative sample using a minimum amount of solvent and/or heat energy, etc. The method 500 may select an optimal set of operations that can be performed by the retrieving tools available downhole and that can achieve or are the closest to achieving the prescribed desired objective. In this example, the model builder 514 utilizes a plurality of times for predicting the outcome of various sampling operations (e.g. injecting a solvent at various rates within allowable limits and heating the formation within the downhole power limitations) for a given set of model parameters. One or more sampling/tool operations is then selected by comparing the predicted outcomes to the desired objective. In one embodiment, the operating parameters are further determined at block 516.

As shown in FIG. 10C, the tool/method selection at block 516 may take into account data from the pretest or other available data, such as fluid composition, fluid mobility or viscosity, formation permeability, reservoir pressure and/or temperature and other physiochemical characteristics of the rock, the formation fluid, or the wellbore fluid.

At block 519, the selected sampling method is performed to retrieve formation fluid. Depending on the particular method used, this may involve several sub-steps. In particular, in some cases the selected sampling/tool operation comprises one or more of sub-steps having operating parameters associated thereto. For example, an injection sub-step may have an injection rate, a temperature of injected fluid and/or an injected total volume associated therewith. Also, a soaking sub-step may have a soaking time period associated therewith, and a sampling sub-step may have a sampling rate associated therewith. Other sub-steps may have operating parameters associated therewith, such as coring bit torque or weight on bit, driving voltage or frequency applied to antenna or coils, etc.

In this exemplary embodiment, the sub-steps include injecting hot fluid into the formation 518*a*, stopping fluid injection 518*b*, and suctioning formation fluid into the tool 518*c*, where the process uses thermal energy to increase formation fluid mobility. As mentioned above, other methods may require the various steps associated with coring or fluid injection sampling.

During the sampling step 519 and any sub-steps associated therewith, various fluid formation parameters may be monitored, as indicated at block 520. For example, fluid pressure, flowrate, reservoir pressure, amount of injected fluid, may be observed using sensors associated with the tool. The measurement may be interpreted to refine values of the reservoir characteristics, for example the flow pattern in the formation may be determined based on pressure response of the formation. The sensors may be provided as integral parts of the first or second retrieving tools 15, 17, or may be separately provided within the overall tool structure.

The information accumulated during the sampling may be used for estimating the state of the sampling information. For example, the method 500 could be used to control the increase in downhole temperature of the formation adjacent to the tool until a desired level of fluid mobility is achieved. The sampling step may include repeated attempts to draw formation fluid at a probe or pretests during a heating phase. Pretest data may be analyzed to determine a fluid mobility. The heating phase may stop as a desired level of fluid mobility is achieved. Also, the information accumulated during sampling may be forwarded to the model builder 514 and used to update or modify the sampling step 519. Thus, as the sampling step 519 is performed and the model builder updated, operation parameters associated to the selected tool/method may be altered based on that feedback.

At block 522, a review of the progress to date is performed to determine whether the first sampling method is successful. The success of a method may be defined in various ways, but may be related to the amount and nature of the fluid obtained from the formation. If the method is deemed successful, then the method is terminated at block 524.

If the first sample method is deemed unsuccessful, the model builder is interrogated at step 525. A decision whether to modify/change the method or to abort the sampling process is made at block 526. If the choice is to abort, then the method is terminated at block 524. Alternatively, if it is decided that the parameters of the current tool should be changed or a new tool should be chosen, the process reverts back to the sampling block 519. The decision whether to adjust/retool or abort may be based at least in part on the revised model builder output that is based on the parameter feedback obtained during the first sample method. At block 525, the updated model builder information is again used to select a tool/method that is appropriate for the particular formation/fluid environment. At this point, the same tool/method may be selected, albeit with new operating parameters, or a different, second retrieving tool/method may be chosen and implanted at block 519. Where the tool includes multiple different retrieving tools, tool selection and switching from the first sampling method to the second sampling method may be performed downhole, without tripping the tool.

There have been described and illustrated herein many embodiments of methods and apparatus for modifying a formation in order to obtain a formation fluid sample. While particular embodiments have been described, it is not intended that the disclosure be limited thereto, as it is intended that the disclosure be as broad in scope as the art will allow and that the specification be read likewise.

What is claimed is:

1. A method of retrieving a formation fluid from a formation adjacent a borehole wall, comprising:

lowering a tool into the wellbore;

initiating a first retrieval process, the first retrieval process including attempting to increase the mobility of the formation fluid;

measuring at least one downhole parameter related to the mobility of the fluid;

changing the first retrieval process based on the measured downhole parameter;

initiating a second retrieval process, the second retrieval process including increasing the mobility of the formation fluid; and retrieving the formation fluid sample from the formation with the tool.

2. The method of claim 1 wherein measuring at least one downhole parameter includes measuring at least one of a mobility of the formation fluid, a pressure of the formation fluid, a temperature, a viscosity of the formation fluid, a flowrate, and a permeability of the formation.

3. The method of claim 1 wherein initiating the first retrieval process, measuring at least one downhole parameter, changing the first retrieval process, and initiating the second retrieval process are all accomplished while the tool is downhole.

4. The method of claim 1 wherein the tool comprises at least one sensor, a processor, and a controller communicably coupled to one another, and wherein changing the first retrieval process comprises:

processing data obtained by the sensor with the processor; and at least partially changing the first retrieval process with the controller.

5. The method of claim 1 wherein initiating the first retrieval process includes at least one of mixing a plurality of fluids to be injected into the formation, injecting fluid into the formation, energizing an RF heating element, energizing a resistive heating element, energizing an ultra-sonic heating element, and energizing a conductive heating element.

6. The method of claim 5 wherein the tool comprises a pump, and wherein changing the first retrieval process comprises changing at least one of a pumping flowrate and a pumping pressure differential.

7. The method of claim 5 wherein the tool comprises an injection mechanism, and wherein changing the first retrieval process comprises changing at least one of a fluid mixing ratio, an amount of fluid injected into the formation, a temperature of the fluid injected into the formation, a flowrate of the fluid injection into the formation, and an injection medium.

8. The method of claim 5 wherein the tool comprises at least one of a heating mechanism at least partially extendable from the tool, a heating mechanism disposed at least partially in the tool, and a heating mechanism disposed at least partially adjacent the tool, and wherein changing the first retrieval process includes changing at least one of an amount of heat emanating from the heating mechanism, an amount of energy provided to the heating mechanism, and a distance the heating mechanism extends into the formation.

9. The method of claim 5 wherein the tool comprises at least one of a plurality of inflatable packers and at least one probe, and wherein changing the first retrieval process comprises changing at least one of a probe-related dimension and a packer-related spacing.

10. The method of claim 1 wherein one of the first and the second retrieval processes comprises initiating a coring process, removing a core from the formation, and placing the core into the tool.

11. The method of claim 10 wherein retrieving formation fluid comprises retrieving formation fluid from the core.

12. The method of claim 11 wherein retrieving formation fluid from the core is accomplished within the wellbore.

13. The method of claim 11 wherein retrieving formation fluid from the core is accomplished at the surface.

* * * * *